US008033268B2

(12) United States Patent
Gwidt et al.

(10) Patent No.: US 8,033,268 B2
(45) Date of Patent: Oct. 11, 2011

(54) ASYNCHRONOUS CONTROL OF HIGH-PRESSURE PUMP FOR DIRECT INJECTION ENGINES

(75) Inventors: Jesse M. Gwidt, Brighton, MI (US); Michael J. Lucido, Northville, MI (US)

(73) Assignee: GM Global Technology Operations LLC

( * ) Notice: Subject to any disclaimer, the term of this patent is extended or adjusted under 35 U.S.C. 154(b) by 422 days.

(21) Appl. No.: 12/392,376

(22) Filed: Feb. 25, 2009

(65) Prior Publication Data

US 2010/0180863 A1 Jul. 22, 2010

Related U.S. Application Data

(60) Provisional application No. 61/146,070, filed on Jan. 21, 2009.

(51) Int. Cl.
*F02M 69/54* (2006.01)

(52) U.S. Cl. ..... 123/446; 123/457; 123/506; 123/511

(58) Field of Classification Search ..... 701/103–105, 701/110, 112, 113; 123/357, 457, 510, 511, 123/179.7, 179.14, 179.16, 179.17, 436, 446, 491, 507, 508, 481, 198 DB
See application file for complete search history.

(56) References Cited

U.S. PATENT DOCUMENTS

| | | | | |
|---|---|---|---|---|
| 6,135,090 | A * | 10/2000 | Kawachi et al. | 123/446 |
| 6,953,025 | B2 * | 10/2005 | Takahashi | 123/497 |
| 7,240,666 | B2 * | 7/2007 | Okamoto | 123/446 |
| 7,325,536 | B2 * | 2/2008 | Okamoto | 123/446 |
| 7,546,832 | B2 * | 6/2009 | Okamoto et al. | 123/506 |
| 7,591,239 | B2 * | 9/2009 | Okamoto | 123/179.17 |

* cited by examiner

*Primary Examiner* — Hai Huynh

(57) ABSTRACT

An engine control system includes a starting module, a position module, and a deactivation module. The starting module determines when a crankshaft starts to rotate and activates a control valve of a fuel pump when the crankshaft starts to rotate. The position module determines a position of the crankshaft and determines a position of a camshaft based on the position of the crankshaft. The camshaft drives the fuel pump. The deactivation module deactivates the control valve when the position module determines the position of the camshaft.

16 Claims, 6 Drawing Sheets

ASYNCHRONOUS CONTROL OF HIGH-PRESSURE PUMP FOR DIRECT INJECTION ENGINES

CROSS-REFERENCE TO RELATED APPLICATIONS

This application claims the benefit of U.S. Provisional Application No. 61/146,070, filed on Jan. 21, 2009. The disclosure of the above application is incorporated herein by reference.

FIELD

The present disclosure relates to control of a high-pressure pump for a direct injection engine, and particularly to high-pressure pump control before engine synchronization.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel system delivers fuel to a direct injection engine at an injection pressure. For example, the injection pressure may include a range of 5-12 Megapascals (MPa). The fuel system may include a fuel tank, a low-pressure pump, a high-pressure pump, a fuel rail, and fuel injectors. The low-pressure pump delivers fuel from the fuel tank to the high-pressure pump. A camshaft may drive the high-pressure pump to pressurize fuel to the injection pressure. The high-pressure pump delivers fuel at the injection pressure to the fuel injectors via the fuel rail. The high-pressure pump may include a fuel supply control valve (hereinafter "control valve"). The control valve regulates an amount of fuel flowing from the low-pressure pump into the high-pressure pump. An engine control module actuates the control valve to regulate the injection pressure in the fuel rail. The engine control module may actuate the control valve based on a position of the camshaft relative to a position of a crankshaft.

SUMMARY

An engine control system comprises a starting module, a position module, and a deactivation module. The starting module determines when a crankshaft starts to rotate and activates a control valve of a fuel pump when the crankshaft starts to rotate. The position module determines a position of the crankshaft and determines a position of a camshaft based on the position of the crankshaft. The camshaft drives the fuel pump. The deactivation module deactivates the control valve when the position module determines the position of the camshaft.

A method comprises determining when a crankshaft starts to rotate and activating a control valve of a fuel pump when the crankshaft starts to rotate. The method further comprises driving the fuel pump using a camshaft. Additionally, the method comprises determining a position of the crankshaft, determining a position of the camshaft based on the position of the crankshaft, and deactivating the control valve when the position of the camshaft is determined.

BRIEF DESCRIPTION OF THE DRAWINGS

The present disclosure will become more fully understood from the detailed description and the accompanying drawings, wherein.

DETAILED DESCRIPTION

Figure 1:
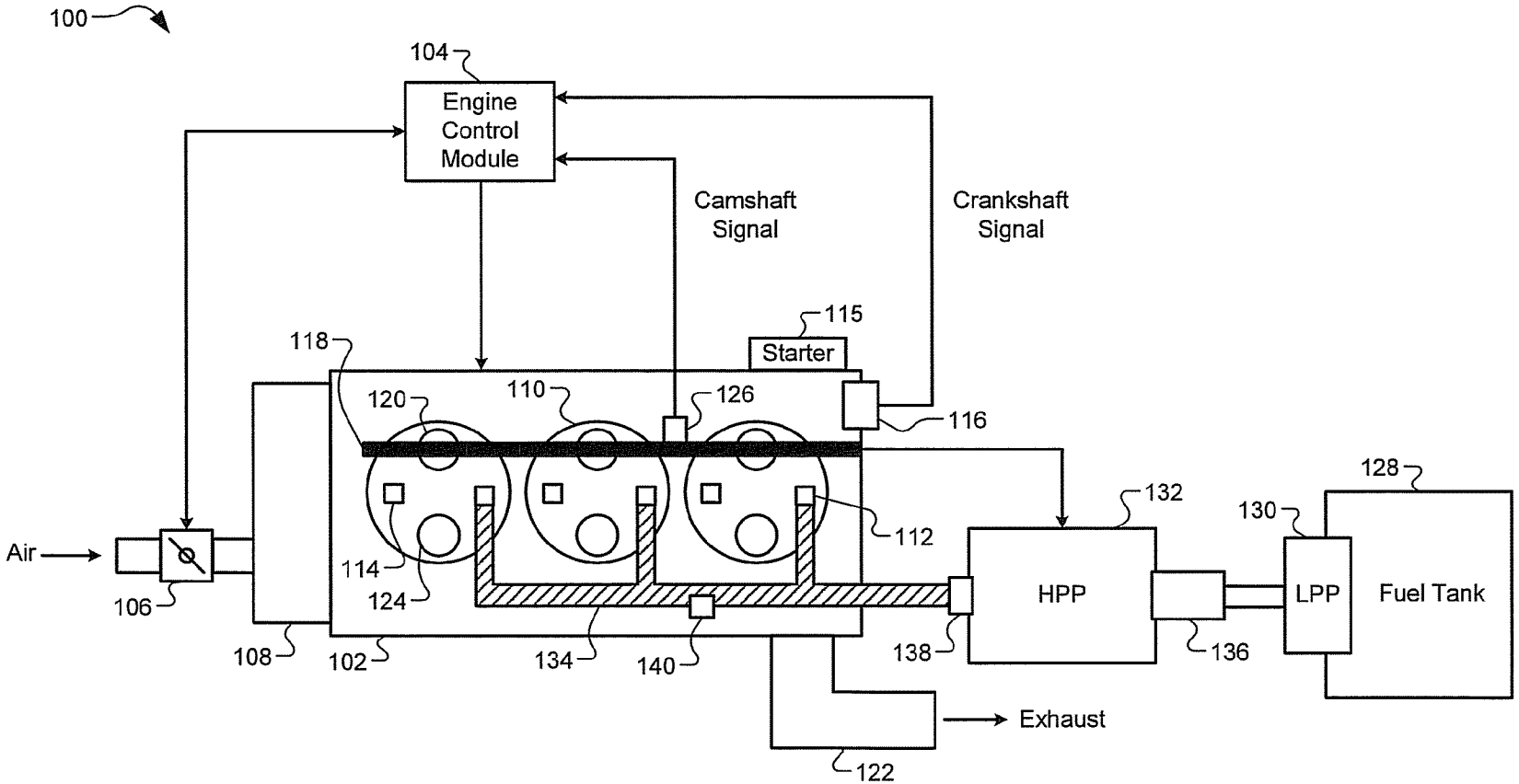
FIG. 1 is a functional block diagram of an engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The engine control module (ECM) actuates the control valve of the high-pressure fuel pump to regulate the fuel injection pressure. Typically, the ECM actuates the control valve based on the position of the camshaft relative to the position of the crankshaft. Actuating the control valve based on the position of the camshaft relative to the position of the crankshaft is called synchronous pump control. The ECM initiates synchronous pump control after an engine starting period during which the ECM determines the position of the camshaft relative to the position of the crankshaft. Typically, the ECM does not actuate the control valve during the starting period. When the control valve includes a normally-open valve, the injection pressure may be less than sufficient after the engine starting period. Accordingly, after the engine starting period, the ECM closes the normally-open valve for a pressurization period to increase the injection pressure. When the control valve includes a normally-closed valve, the injection pressure may be greater than sufficient after the engine starting period. Accordingly, fuel may be injected across a cylinder prior to combustion, which may release excess hydrocarbons into the exhaust.

An asynchronous starting system according to the present disclosure actuates the control valve prior to synchronous pump control. The system actuates the control valve when the system determines that the crankshaft has started to rotate. The system actuates the control valve until synchronous pump control is initiated. Alternatively, the system may actuate the control valve for a predetermined period to prevent thermal damage to the control valve. When the control valve includes the normally-closed valve, the system may increase fuel pressure prior to synchronous pump control. Accordingly, the system may eliminate the pressurization period. When the system includes the normally-closed valve, the system may reduce fuel pressure prior to synchronous control. Accordingly, the system may reduce the amount of hydrocarbons in the exhaust.

Referring now to FIG. 1, an exemplary engine system 100 includes a combustion engine 102. While a spark ignition engine is illustrated, compression ignition engines are also contemplated. An ECM 104 communicates with components of the engine system 100. The components may include the engine 102, sensors, and actuators as discussed herein. The ECM 104 may implement the asynchronous starting system of the present disclosure.

The ECM 104 may actuate a throttle 106 to regulate airflow into an intake manifold 108. Air within the intake manifold 108 is distributed into cylinders 110. The ECM 104 actuates fuel injectors 112 to inject fuel into the cylinders 110. The ECM 104 may actuate spark plugs 114 to ignite an air/fuel mixture in the cylinders 110. Alternatively, the air/fuel mixture may be ignited by compression in a compression ignition engine. While three cylinders 110 of the engine 102 are shown, the engine 102 may include more than three cylinders 110.

An engine crankshaft (not shown) rotates at engine speed or a rate that is proportional to the engine speed. An engine starter 115 initiates rotation of the crankshaft prior to fuel injection. Initial rotation of the crankshaft prior to fuel injection may be called "engine start-up." The engine starter 115 may include an electric motor.

A crankshaft sensor 116 generates a crankshaft signal that indicates rotation of the crankshaft. For example, the crankshaft signal may indicate a passing of teeth on a gear connected to the crankshaft. Typically, the crankshaft signal indicates a position of the crankshaft once during each revolution of the crankshaft. For example, the crankshaft signal may indicate a passing of an elongated tooth that corresponds to the position of the crankshaft. For example only, the crankshaft sensor 116 may include at least one of a variable reluctance and a Hall-effect sensor. The position of the crankshaft may be sensed using other suitable methods.

The ECM 104 determines the position of the crankshaft during engine operation based on the crankshaft signal. The position of the crankshaft may be unknown when the engine 102 is started. At engine start-up, the ECM 104 may initially determine the position of the crankshaft when the crankshaft signal first indicates the position of the crankshaft. For example, the ECM 104 may initially determine the position of the crankshaft when the crankshaft signal indicates a first passing of the elongated tooth.

The ECM 104 may determine a position of a piston (not shown) based on the position of the crankshaft. For example, the ECM 104 may determine that the piston is at top dead center (TDC) based on the position of the crankshaft. The ECM 104 may actuate the fuel injectors 112 and the spark plugs 114 based on the position of the piston.

An intake camshaft 118 regulates a position of an intake valve 120 to enable air to enter the cylinder 110. Combustion exhaust within the cylinder 110 is forced out through an exhaust manifold 122 when an exhaust valve 124 is in an open position. An exhaust camshaft (not shown) regulates a position of the exhaust valve 124. Although single intake and exhaust valves 120, 124 are illustrated, the engine 102 may include multiple intake and exhaust valves 120, 124 per cylinder 110.

A camshaft sensor 126 generates a camshaft signal that indicates rotation of the intake camshaft 118. For example, the camshaft signal may indicate a passing of teeth on a gear connected to the intake camshaft 118. Typically, the camshaft signal indicates a position of the intake camshaft 118 once during each revolution of the intake camshaft 118. For example, the camshaft signal may indicate a passing of an elongated tooth that corresponds to the position of the intake camshaft 118.

The ECM 104 may determine the position of the intake camshaft 118 during engine operation based on at least one of the camshaft signal and the crankshaft signal. When the engine 102 is started, the position of the intake camshaft 118 may be unknown. At engine start-up, the ECM 104 may initially determine the position of the intake camshaft 118 when the camshaft signal first indicates the position of the intake camshaft 118. For example, the ECM 104 may initially determine the position of the intake camshaft 118 when the camshaft signal indicates a first passing of the elongated tooth.

While the camshaft sensor 126 indicates rotation of the intake camshaft 118, the camshaft sensor 126 may also indicate rotation of the exhaust camshaft. For example only, the camshaft sensor 126 may include at least one of a variable reluctance and a Hall-effect sensor. The position of the intake camshaft 118 may be sensed using other suitable methods.

A fuel system supplies fuel to the engine 102. The fuel system may include a fuel tank 128, a low-pressure pump (LPP) 130, a high-pressure pump (HPP) 132, a fuel rail 134, and the fuel injectors 112. Fuel is stored in the fuel tank 128. The LPP 130 pumps fuel from the fuel tank 128 and provides fuel to the HPP 132. The HPP 132 pressurizes fuel for delivery to the fuel injectors 112 via the fuel rail 134. The ECM 104 actuates a control valve 136 to regulate fuel provided from the LPP 130 to the HPP 132. Fuel may flow from the LPP 130 to the HPP 132 when the control valve 136 is open.

The intake camshaft 118 may drive the HPP 132 to pressurize fuel in the HPP 132. The intake camshaft 118 may include lobes that operate a pump driver (not shown) of the HPP 132 to pressurize fuel in the HPP 132. For example, the intake camshaft 118 may include 2-4 lobes.

The ECM 104 actuates the control valve 136 to open/close the control valve 136. The ECM 104 may provide a voltage and/or current to the control valve 136 to actuate the control valve 136. The ECM 104 activates the control valve 136 when the ECM 104 provides the voltage and/or current to the control valve 136. The control valve 136 may be deactivated when the ECM 104 does not provide the voltage and/or current to the control valve 136.

The control valve 136 may include the normally-open valve or the normally-closed valve. The ECM 104 activates the normally-open valve to close the normally-open valve. The ECM 104 deactivates the normally-open valve to open the normally-open valve. The ECM 104 activates the normally-closed valve to open the normally-closed valve. The ECM 104 deactivates the normally-closed valve to close the normally-closed valve.

The HPP 132 includes an output valve 138 that controls the flow of fuel between the HPP 132 and the fuel rail 134. For example, the output valve 138 may allow fuel to flow from the HPP 132 to the fuel rail 134 when fuel pressure in the HPP 132 is greater than fuel pressure in the fuel rail 134. The output valve 138 may restrict the flow of fuel into the HPP 132 from the fuel rail 134. The output valve 138 may include a check valve.

The fuel rail 134 may include a rail pressure sensor 140. The rail pressure sensor 140 generates a rail pressure signal that indicates fuel pressure in the fuel rail 134. Fuel pressure in the fuel rail 134 decreases when the fuel injectors 112 inject fuel. The HPP 132 maintains fuel pressure in the fuel rail 134.

The fuel rail 134 may include a pressure control valve (not shown) that releases fuel from the fuel rail 134 when fuel pressure in the fuel rail 134 is greater than or equal to a pressure threshold.

The intake camshaft 118 may continue to drive the HPP 132 during engine operation. The ECM 104 actuates the control valve 136 to control fuel pressure in the HPP 132. A cycle of the HPP 132 may be divided into a suction stroke and a delivery stroke. The HPP 132 may intake fuel from the LPP 130 during the suction stroke. The HPP 132 may pressurize fuel in the HPP 132 for delivery to the fuel rail 134 during the delivery stroke. The ECM 104 may actuate the control valve 136 based on the position of the crankshaft to deliver fuel to the fuel rail 134 at a sufficient pressure for injection. For example, the ECM 104 may close the control valve 136 during the delivery stroke to increase fuel pressure in the fuel rail 134 for injection.

Figure 2:
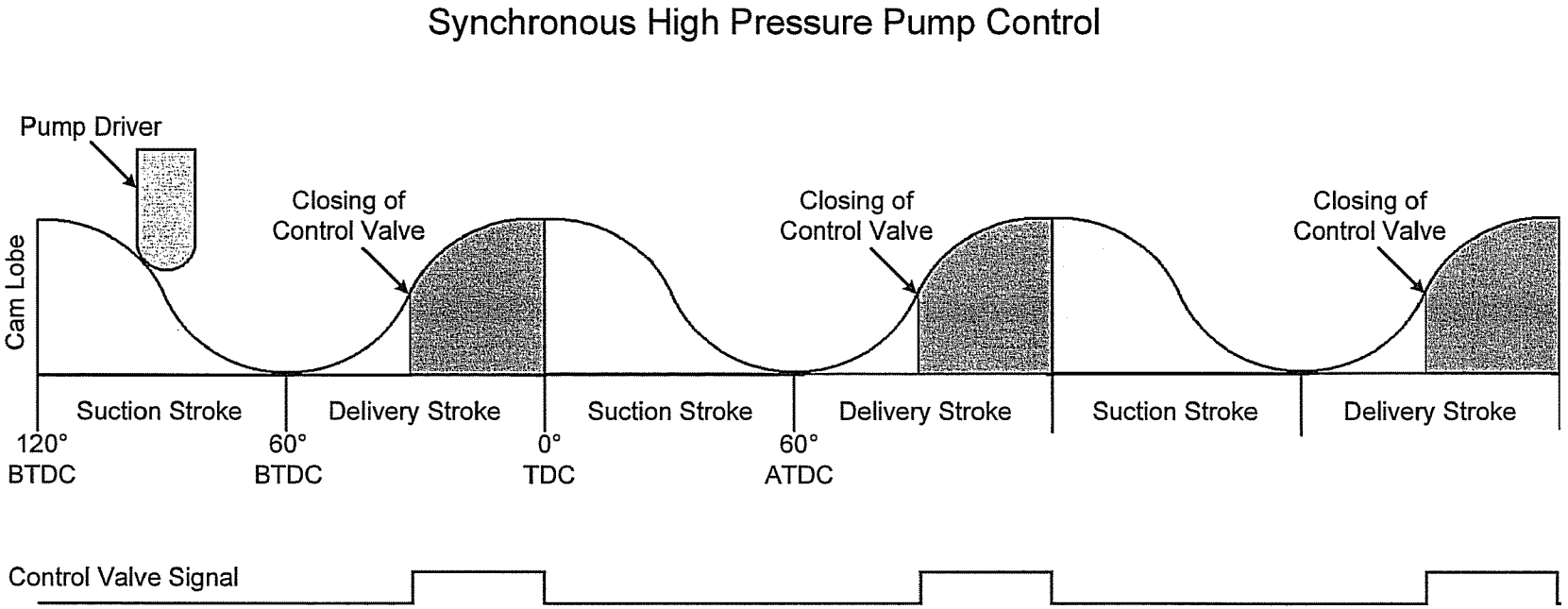
FIG. 2 illustrates synchronous high-pressure pump control.

Referring now to FIG. 2, the ECM 104 may actuate the control valve 136 based on the position of the crankshaft and the position of the intake camshaft 118. The ECM 104 actuates the control valve 136 using a control valve signal. The pump driver drives the HPP 132. The graph depicts the pump driver following a contour of a cam lobe on the intake camshaft 118. The intake camshaft 118 illustrated includes three lobes. The HPP 132 operates in the suction stroke between 120° before top dead center (BTDC) and 60° BTDC. The ECM 104 deactivates the normally-open valve during the suction stroke so that fuel may flow from the LPP 130 to the HPP 132. The ECM 104 sets the control valve signal low to deactivate the normally-open valve. The HPP 132 operates in the delivery stroke between 60° BTDC and TDC. The ECM 104 activates the normally-open valve during the delivery stroke so that the HPP 132 may pressurize fuel in the HPP 132. The ECM 104 sets the control valve signal high to activate the normally-open valve.

The ECM 104 may actuate the control valve 136 to open/close based on the position of the intake camshaft 118 relative to the position of the crankshaft during engine operation. Accordingly, the ECM 104 may perform synchronous pump control. Initiating synchronous pump control at engine start-up includes determining the position of the crankshaft, determining the position of the intake camshaft 118, and determining the position of the intake camshaft 118 relative to the position of the crankshaft.

The asynchronous starting system of the present disclosure activates the control valve 136 when the crankshaft starts to rotate at engine start-up. The system activates the control valve 136 until the ECM 104 initiates synchronous pump control. Alternatively, the system may activate the control valve 136 until a temperature of the control valve 136 is greater than or equal to a temperature threshold. The system may deactivate the control valve 136 when the temperature of the control valve 136 is greater than or equal to the temperature threshold to prevent thermal damage to the control valve 136.

Figure 3:
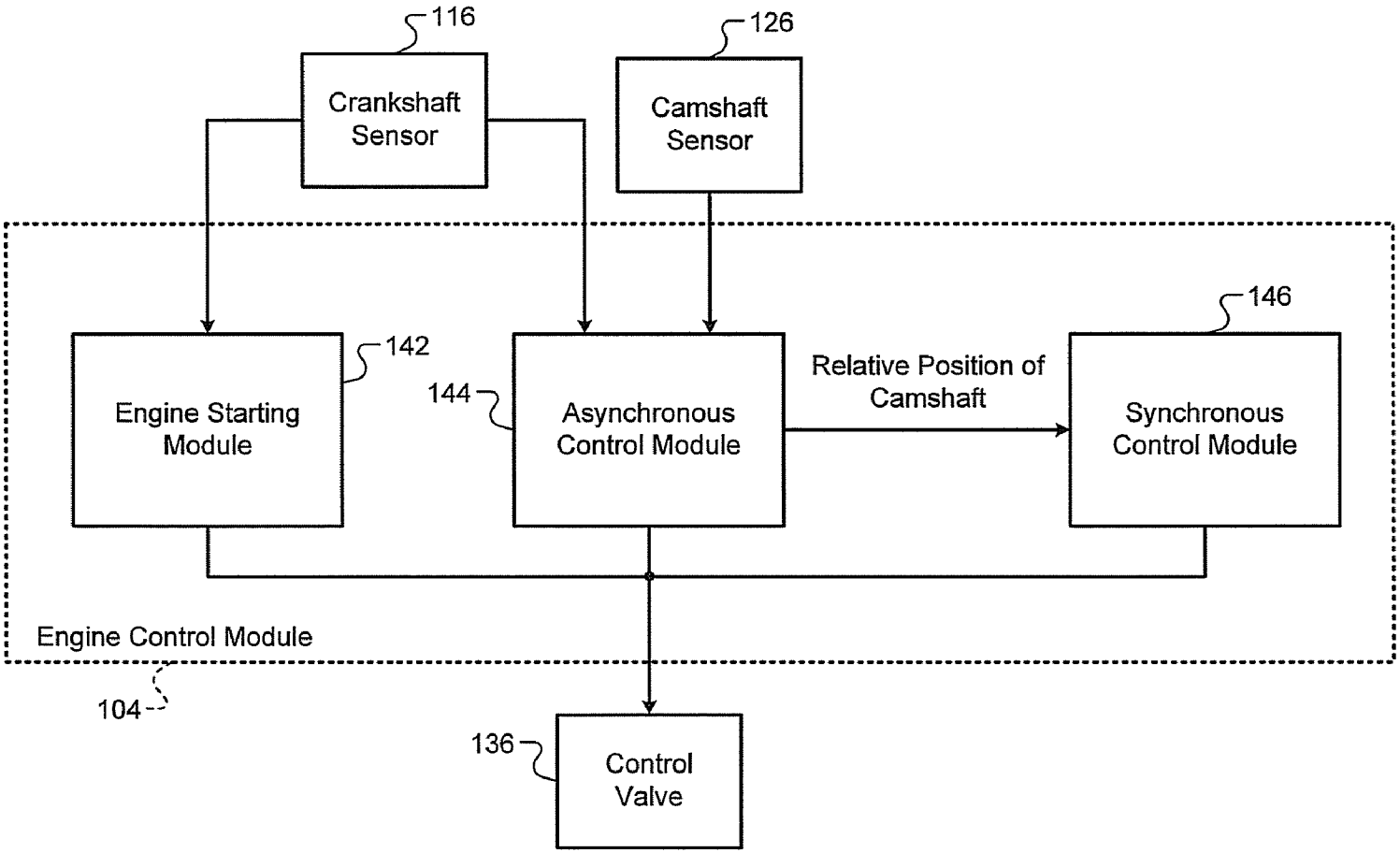
FIG. 3 is a functional block diagram of an engine control module according to the present disclosure.

Referring now to FIG. 3, the ECM 104 includes an engine starting module 142, an asynchronous control module 144, and a synchronous control module 146. The engine starting module 142 determines when the engine 102 starts. The engine starting module 142 determines when the crankshaft starts to rotate after the engine 102 starts. The engine starting module 142 may determine when the crankshaft starts to rotate based on the crankshaft signal. For example, the engine starting module 142 may determine that the crankshaft starts to rotate when the crankshaft signal indicates the passing of teeth on the gear connected to the crankshaft.

The engine starting module 142 activates the control valve 136 when the crankshaft starts to rotate. The engine starting module 142 applies a voltage and/or current to the control valve 136 to activate the control valve 136. Accordingly, the engine starting module 142 closes the control valve 136 when the control valve 136 includes the normally-open valve. The engine starting module 142 opens the control valve 136 when the control valve 136 includes the normally-closed valve.

The asynchronous control module 144 determines when synchronous pump control may be initiated after the engine 102 starts. The asynchronous control module 144 determines when synchronous pump control may be initiated based on the position of the crankshaft and the position of the intake camshaft 118. The asynchronous control module 144 may determine the position of the crankshaft and the position of the intake camshaft 118 based on the crankshaft signal and the camshaft signal, respectively.

The asynchronous control module 144 determines the position of the crankshaft after the engine 102 starts. The asynchronous control module 144 determines the position of the intake camshaft 118 after the asynchronous control module 144 determines the position of the crankshaft. The asynchronous control module 144 determines the position of the intake camshaft 118 relative to the position of the crankshaft. The position of the intake camshaft 118 relative to the position of the crankshaft may be called a "relative position of the intake camshaft 118."

The asynchronous control module 144 deactivates the control valve 136 when the relative position of the intake camshaft 118 has been determined. The asynchronous control module 144 determines that synchronous pump control may be initiated when the relative position of the intake camshaft 118 has been determined. The asynchronous control module outputs the relative position of the intake camshaft 118 to the synchronous control module 146.

Alternatively, the asynchronous control module 144 may deactivate the control valve 136 when the temperature of the control valve 136 is greater than or equal to the temperature threshold. The asynchronous control module 144 may deactivate the control valve 136 to prevent thermal damage to the control valve 136. The control valve 136 may be thermally damaged due to the voltage and/or current applied to the control valve 136 to activate the control valve 136. The asynchronous control module 144 may determine that the temperature of the control valve 136 is greater than or equal to the temperature threshold based on the voltage and/or current applied to activate the control valve 136. The asynchronous control module 144 may determine that the temperature of the control valve 136 is greater than or equal to the temperature threshold based on a period during which the control valve 136 is activated using the voltage and/or current.

The synchronous control module 146 receives the relative position of the intake camshaft 118 from the asynchronous control module 144. The synchronous control module 146 initiates synchronous pump control based on the relative position of the intake camshaft 118. During synchronous pump control, the synchronous control module 146 may activate/deactivate the control valve 136 based on the position of the crankshaft. For example, the synchronous control module 146 may close the control valve 136 during each delivery stroke based on the position of the crankshaft.

Figure 4:
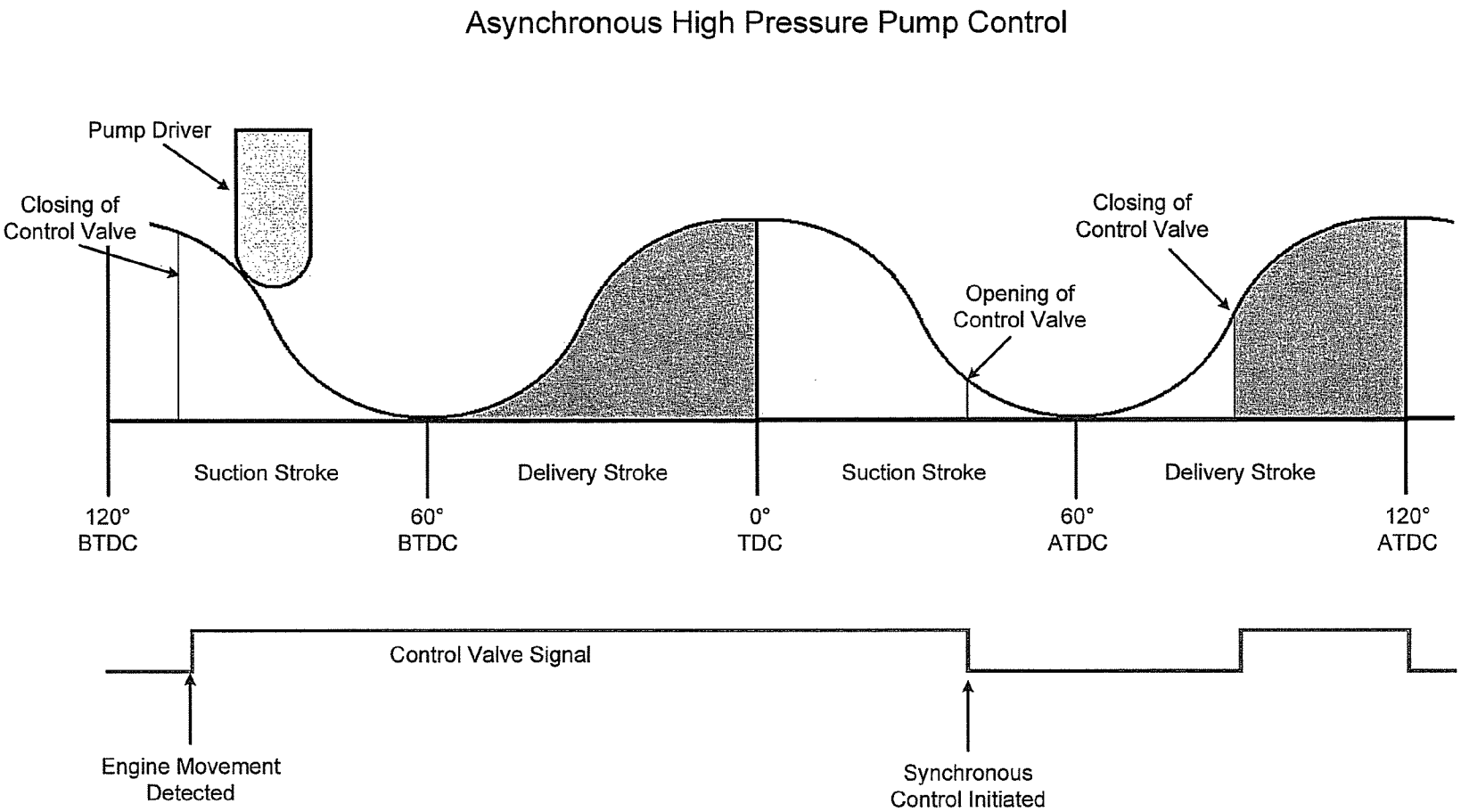
FIG. 4 illustrates asynchronous high-pressure pump control according to the present disclosure.

Referring now to FIG. 4, a graph illustrates operation of an exemplary asynchronous starting system that includes the normally-open valve. The engine starting module 142 activates the normally-open valve to close the normally-open valve when engine movement is detected between 120° BTDC and 60° BTDC. The engine starting module 142 sets the control valve signal high to activate the normally-open valve. The engine starting module 142 activates the normally-open valve until synchronous pump control may be initiated. The asynchronous control module 144 determines that synchronous pump control may be initiated between TDC and 60° ATDC. The asynchronous control module 144 deactivates the normally-open valve when synchronous pump control may be initiated. The synchronous control module 146 initiates synchronous pump control after the asynchronous control module 144 deactivates the normally-open valve.

While FIG. 4 illustrates the asynchronous starting system including the normally-open valve, the asynchronous starting system may include the normally-closed valve. When the asynchronous starting system includes the normally-closed valve, the engine starting module 142 activates the normally-closed valve to open when engine movement is detected. The engine starting module 142 activates the normally-closed valve until synchronous pump control may be initiated. The asynchronous control module 144 deactivates the normally-closed valve to close when synchronous pump control may be initiated. The synchronous control module 146 initiates synchronous pump control after the asynchronous control module 144 deactivates the normally-closed valve.

Figure 5:
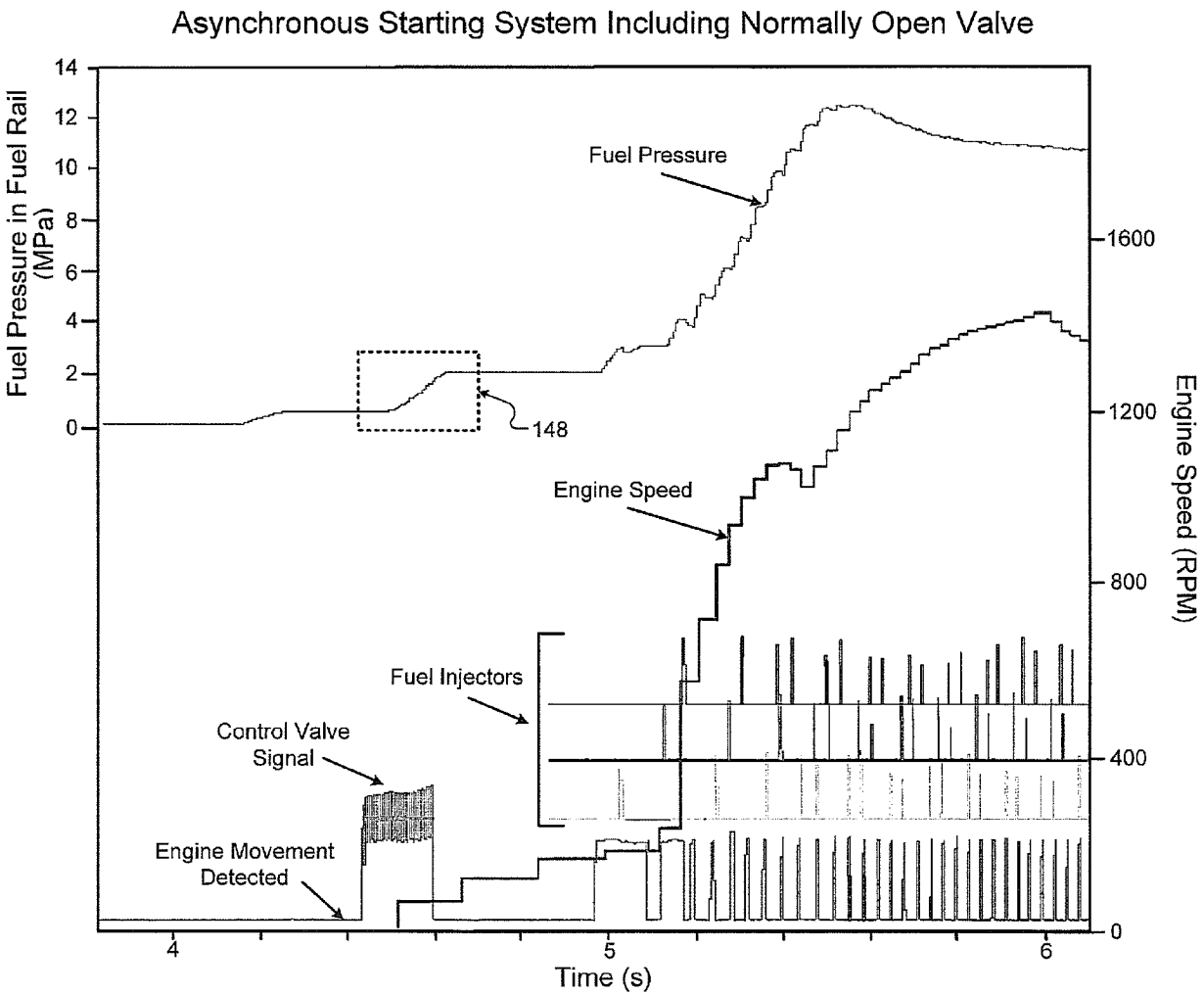
FIG. 5 is a graph of fuel pressure and engine speed relative to time when a control valve is actuated according to the present disclosure.

Referring now to FIG. 5, the asynchronous starting system that includes the normally-open valve may increase fuel pressure in the fuel rail 134 when engine movement is detected. The engine starting module 142 sets the control valve signal high when engine movement is detected. Fuel pressure in the fuel rail 134 increases approximately 2 MPa after the control valve signal closes the normally-open valve, as indicated at 148. Fuel is injected at sufficient pressure upon the subsequent closing of the normally-open valve.

Figure 6:
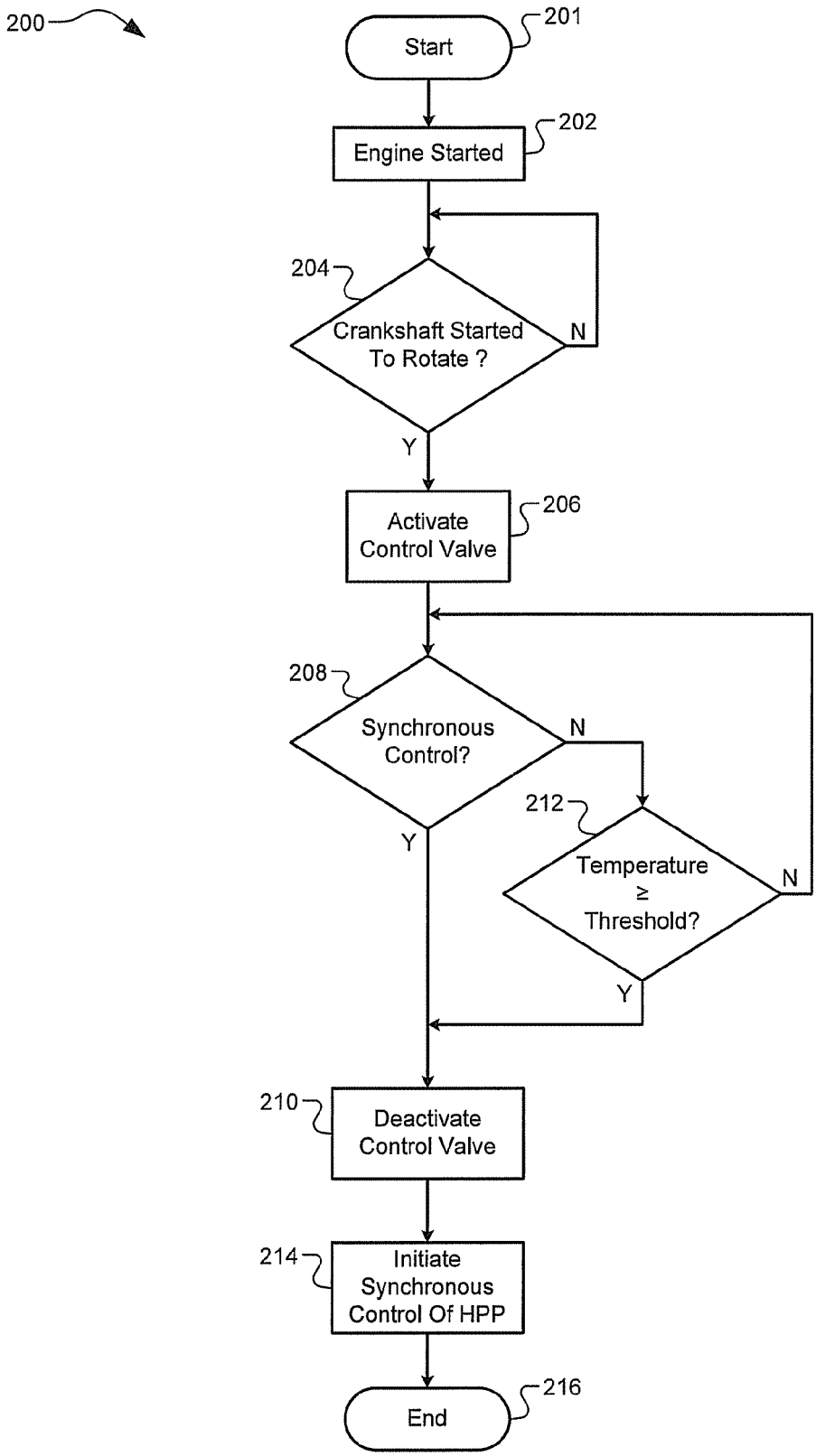
FIG. 6 is a flowchart of a method for asynchronous control of a high-pressure pump according to the present disclosure.

Referring now to FIG. 6, a method 200 for asynchronous control of a HPP starts in step 201. In step 202, the engine starting module 142 determines that the engine 102 has started. In step 204, the engine starting module 142 determines whether the crankshaft has started to rotate. If the result of step 204 is false, the method 200 repeats step 204. If the result of step 204 is true, the method 200 continues with step 206. In step 206, the engine starting module 142 activates the control valve 136.

In step 208, the asynchronous control module 144 determines whether synchronous pump control may be initiated. If the result of step 208 is true, the asynchronous control module 144 deactivates the control valve 136 in step 210. If the result of step 208 is false, the method 200 continues with step 212. In step 212, the asynchronous control module 144 determines whether the temperature of the control valve 136 is greater than or equal to the temperature threshold. If the result of step 212 is false, the method 200 repeats step 208. If the result of step 212 is true, the method 200 continues with step 210. In step 214, the synchronous control module 146 actuates the control valve 136 based on the position of the crankshaft. The method 200 ends in step 216.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system comprising:

a starting module that determines when a crankshaft starts to rotate and that activates a control valve of a fuel pump when said crankshaft starts to rotate;

a position module that determines a position of said crankshaft and that determines a position of a camshaft based on said position of said crankshaft, wherein said camshaft drives said fuel pump; and a deactivation module that deactivates said control valve when said position module determines said position of said camshaft.

2. The engine control system of claim 1 wherein said deactivation module deactivates said control valve when a predetermined period has elapsed after said starting module activates said control valve.

3. The engine control system of claim 1 wherein said deactivation module deactivates said control valve based on a temperature of said control valve.

4. The engine control system of claim 3 wherein said deactivation module determines said temperature of said control valve based on at least one of a voltage used to activate said control valve, current used to activate said control valve, and a duration for which said control valve is activated.

5. The engine control system of claim 1 wherein said starting module activates said control valve to close when said control valve is a normally-open control valve.

6. The engine control system of claim 1 wherein said deactivation module deactivates said control valve to open when said control valve is a normally-open control valve.

7. The engine control system of claim 1 wherein said starting module activates said control valve to open when said control valve is a normally-closed control valve.

8. The engine control system of claim 1 wherein said deactivation module deactivates said control valve to close when said control valve is a normally-closed control valve.

9. A method comprising:

determining when a crankshaft starts to rotate;

activating a control valve of a fuel pump when said crankshaft starts to rotate;

driving said fuel pump using a camshaft;

determining a position of said crankshaft;

determining a position of said camshaft based on said position of said crankshaft; and deactivating said control valve when said position of said camshaft is determined.

10. The method of claim 9 further comprising deactivating said control valve when a predetermined period has elapsed after said control valve is activated.

11. The method of claim 9 further comprising deactivating said control valve based on a temperature of said control valve.

12. The method of claim 11 further comprising determining said temperature of said control valve based on at least one of a voltage used to activate said control valve, current used to activate said control valve, and a duration for which said control valve is activated.

13. The method of claim 9 further comprising activating said control valve to close when said control valve is a normally-open control valve.

14. The method of claim 9 further comprising deactivating said control valve to open when said control valve is a normally-open control valve.

15. The method of claim 9 further comprising activating said control valve to open when said control valve is a normally-closed control valve.

16. The method of claim 9 further comprising deactivating said control valve to close when said control valve is a normally-closed control valve.

* * * * *